United States Patent [19]

Behr et al.

[11] Patent Number: 4,852,810

[45] Date of Patent: Aug. 1, 1989

[54] APPARATUS FOR ELECTROSTATIC COATING OF OBJECTS

[75] Inventors: Hans Behr, Stuttgart; Kurt Vetter, Remseck; Rolf Schneider, Burgstetten; Fred Luderer, Leutenbach, all of Fed. Rep. of Germany

[73] Assignee: Behr-Industrieanlagen GmbH & Co., Ingersheim, Fed. Rep. of Germany

[21] Appl. No.: 207,022

[22] Filed: Jun. 14, 1988

Related U.S. Application Data

[63] Continuation of Ser. No. 12,082, Feb. 6, 1987, abandoned.

[30] Foreign Application Priority Data

Mar. 19, 1986 [DE] Fed. Rep. of Germany ..... 3609240

[51] Int. Cl.[4] ..... B05B 5/04

[52] U.S. Cl. ..... 239/703; 239/104; 239/706

[58] Field of Search ..... 239/105, 223, 224, 700–703, 239/706, 707, 704, 296, 104

[56] References Cited

U.S. PATENT DOCUMENTS

| | | | |
|---|---|---|---|
| 2,710,773 | 6/1955 | Sedlacsik | 239/707 |
| 2,955,565 | 10/1960 | Schotland | 239/703 |
| 2,960,273 | 11/1960 | Croskey et al. | 239/704 |
| 3,051,394 | 8/1962 | Sedlacsik, Jr. | 239/703 |
| 3,393,662 | 7/1968 | Blackwell | 239/706 |
| 3,408,985 | 11/1968 | Sedlacsik, Jr. | 239/706 |
| 3,837,573 | 9/1974 | Wagner | 239/707 |
| 3,940,061 | 2/1976 | Gimple et al. | 239/707 |
| 4,114,810 | 9/1978 | Masuda | 239/706 |
| 4,440,350 | 4/1984 | Dietz et al. | 239/703 |
| 4,515,105 | 5/1985 | Danta et al. | 239/707 |
| 4,555,058 | 11/1985 | Weinstein et al. | 239/296 |
| 4,589,597 | 5/1986 | Robisch et al. | 239/703 |

*Primary Examiner*—Andres Kashnikow
*Assistant Examiner*—Michael J. Forman
*Attorney, Agent, or Firm*—Reising, Ethington, Barnard, Perry & Milton

[57] ABSTRACT

In an apparatus for the use of so-called water enamels or some other similarly conductive coating material, the electrical field for charging the sprayed particles is produced between the grounded spraying edge (6) of a bell-shaped atomizer (10) and a large number of external electrodes (10) inserted into an annular element (20) made of an insulating material.

22 Claims, 2 Drawing Sheets

APPARATUS FOR ELECTROSTATIC COATING OF OBJECTS

This application is a continuation, of application Ser. No. 012,082, filed Feb. 6, 1987, now abandoned.

TECHNICAL FIELD

The subject invention relates to an apparatus for electrostatic coating of objects with an electrically conductive material and, particularly, an apparatus utilizing a rotary atomizer.

BACKGROUND ART

Typically, an electrostatic coating apparatus is used, for example, for coating automobile bodies. In contrast to conventional systems, the electrically charged spraying head is replaced by an arrangement of external electrodes at a high voltage potential. This arrangement is known to have substantial advantages when used with highly conductive spraying materials such as so-called water enamels (cf. German OS No. 34 29 075). Moreover, this arrangement eliminates considerable insulating problems since all lines carrying paint may be grounded as far back as the spraying head.

However, the problem with an apparatus having external electrodes is that it is extremely difficult to achieve a satisfactory degree of application, which is dependent upon satisfactory charging of the sprayed coating material, while preventing the coating material from contaminating the spraying device, electrodes and electrode holders. For this reason, the apparatus disclosed in German OS No. 34 29 075 has only two, three or,at the most, four charging electrodes, each of which is embedded in a plastic holder spaced radially from the external housing of the spraying head and projecting towards the object to be coated. Each of these holders contains a high voltage cable running to the respective electrode and is connected, at its rear end, to an annular element which is located upon the external housing and is also made of plastic. Although this design has proved itself in practice, it is impossible under certain operating conditions to overcome all of the problems aforementioned regarding the danger of contamination. Furthermore, as a result of the restriction to a maximum of four external electrodes, there is a danger of nonuniform "spray patterns" arising from paint concentrations in the vicinity of the electrodes.

STATEMENT OF INVENTION AND ADVANTAGES

The subject invention includes an apparatus for electrostatic coating objects with an electrically conductive coating material and including a spraying head to spray the coating material and an external housing connected to the spraying head. A line supplies the coating material from a storage system to a spraying edge on the spraying head. The line and coating material are at ground potential to the spraying head. Needle-like charging electrodes are distributed radially around the spraying head on a circle concentric with the axis thereof and are spaced at uniform angular distances. The electrodes are connected to a high voltage source for the purpose of producing an electrical field for charging the coating material. The radial distance between the front ends of the electrodes facing the object to be coated and the spraying head is twice the diameter of the spraying head. An electrode-mounting arrangement is included and which is made of an insulating material in which the charging electrodes, except for their front ends, are enclosed. The mounting arrangement has at least one support running radially from the external housing of the spraying head and containing a high voltage conductor connected electrically to the charging electrodes. The apparatus is characterized by an annular element surrounding the external housing of the spraying head at a distance therefrom and is made of an insulating material. The charging electrodes are inserted into the annular element.

Accordingly, the subject invention provides a coating apparatus with external electrodes which applies the coating material efficiently but avoids, as far as possible, contamination of the spraying unit and ensures a uniform spray pattern on the object to be coated.

The subject invention is based upon the surprising discovery that problems arising from the use of highly conductive materials (as outlined in German OS No. 34 29 075) aforementioned may be overcome by arranging a relatively large number of external electrodes around the spraying head, as long as care is taken to ensure adequate insulation between the electrode tips on the outside of the holders. This insulation is reduced by a substantial deposit of conductive coating material upon the end face of the annular element constituting the electrode holder. This causes an abrupt drop in field strength at the electrode tips resulting in an increase in contamination. It was found that, in the case of electrically conductive contamination of the annular electrode holder between the electrode tips, the coating material reached the object to be coated rarely or at least only irregularly; instead, it is mainly the apparatus itself that is coated. The same would be true if a metal mounting element were used for the electrodes. On the other hand, the danger of contamination of the annular element is not reduced by the distance between the charging electrodes. On the contrary, a minimum number of electrodes is necessary. This depends upon the diameter of the annular element which may possibly be related to the need for an adequate electrical field. For example, if the diameter of the circle containing the ends of the electrodes is about 400 mm, there should be at least eighteen electrodes, in which case the distance between them would be 70 mm at the most, if no special additional measures are provided to prevent contamination.

FIGURES IN THE DRAWING

Other advantages of the present invention will be readily appreciated as the same becomes better understood by reference to the following detailed description when considered in connection with the accompanying drawings wherein.

Figure 1:
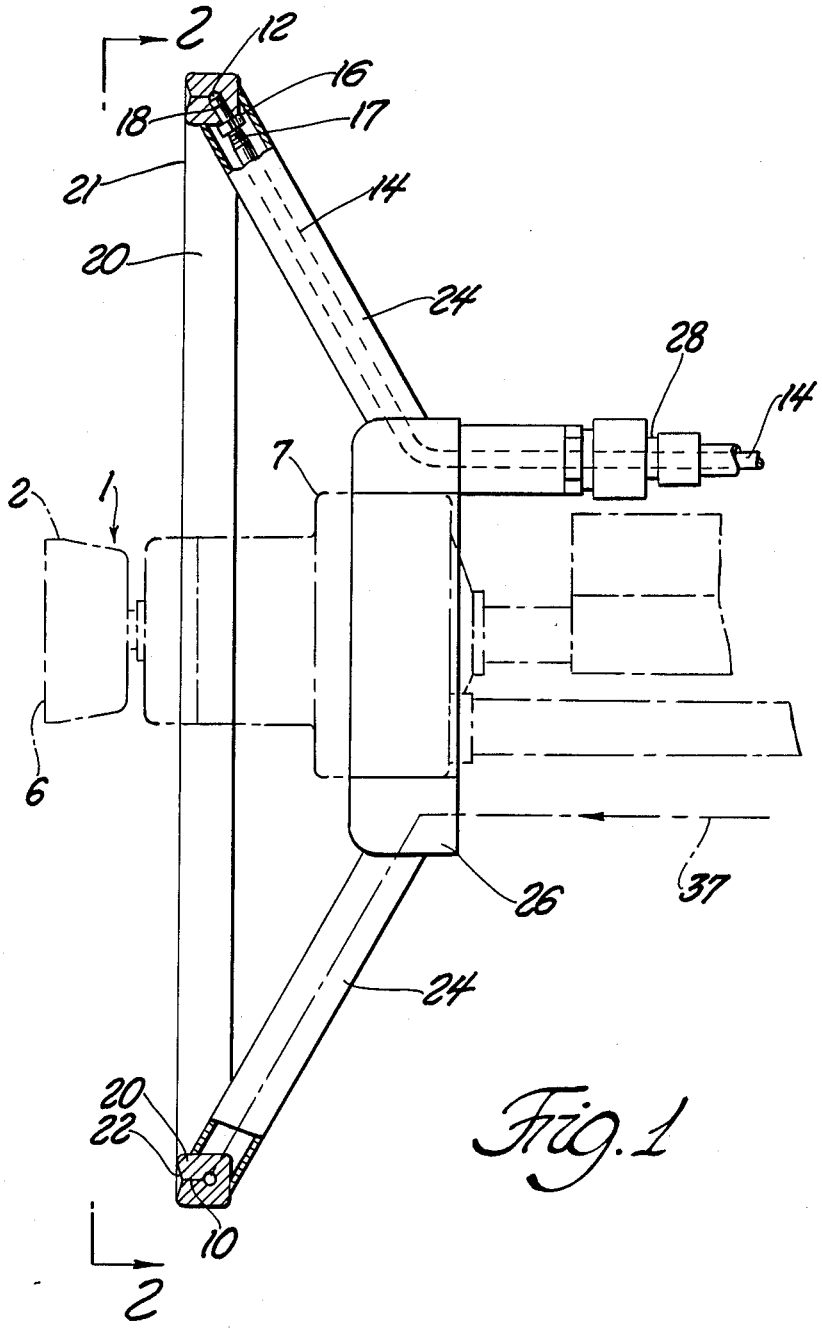
FIG. 1 is a side elevational view of the subject invention.
Figure 2:
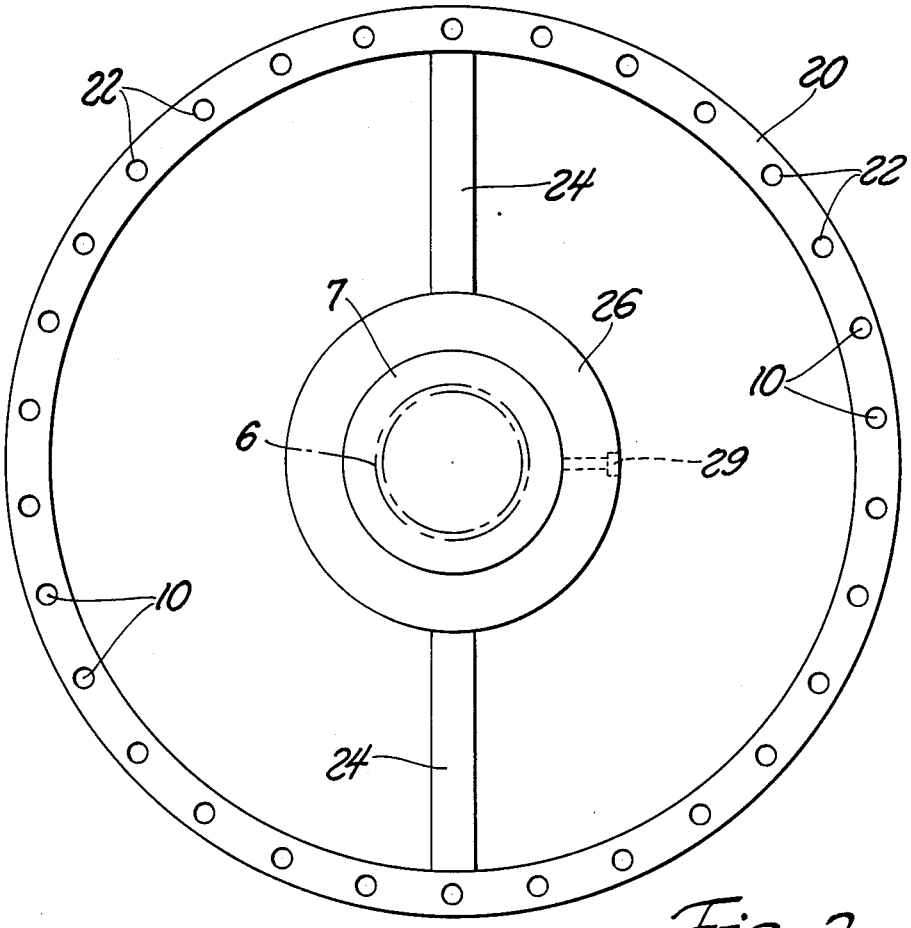
FIG. 2 is a plan view of the subject invention according to FIG. 1, as seen from the object to be coated.

An apparatus for electrostatic coating of objects with an electrically conductive coating material is generally shown in FIG. 1.

The apparatus includes a spraying device in the form of a rotary atomizer of the known bell-type. Bell plate 2 thereof, forming the spraying head, may preferably be driven by a high speed air turbine. A line (not shown) feeding the enamel or other coating materials from a storage system to bell plate 2, runs along the axis of the spraying device. Since this line may be, for example, in the form of a grounded metal pipe, the conductive coating material, such as water enamel or the like, is at ground potential as far as spraying edge 6 of bell plate 2.

The object to be coated (not shown) is also at ground potential. It may, for example, be a part of an automobile body arranged at an axial distance in front of the bell plate.

The spraying device may have an external housing 7 made of an insulating plastic, for example, polyacetate plastic (more particularly while POM) or the like.

The coating material mostly sprayed radially from the spraying edge 6 is charged by means of needle-like charging electrode means 10 arranged from a circle concentric with the axis of the spraying device and having a diameter of about 400 mm, the electrodes being spaced at uniform angular distances. The charging electrodes are arranged axially parallel with their main central parts and embedded in a continuous electrode mounting means 20 as shown in FIG. 1. The front end or tip of each electrode 10 is located or disposed in a depression 22 in end face 21 of annular element 20 which may be an insulated angular ring facing the object to be coated. The depression 22 opens outwardly at an angle which should be more than 90° (for example, about 120° ). Among other things, this facilitates any necessary cleaning of electrode tips. The rear ends of the charging electrodes 10 are connected in an electrically conductive manner to continuous electrical conductor 12 disposed within the electrode mounting means 20 which connects all of the electrodes 10 together. The annular conductor 12 is made of wire or wire mesh for the purpose of electrical insulation and should be completely embedded in the interior of the ring 20.

Both the material of external housing 7 and, in particular, the insulating material of the electrode mounting means 20 have a certain influence on field distribution and the danger of contamination related thereto. The annular ring 20 may consist of polypropylene, for example (in particular PPH). The ring 20 is secured to external housing 7 of the spraying device by means of two spokes 24 also made of an insulating material. These spokes run from a plastic ring 26 located upon external housing 7 radially, but preferably toward the object to be coated and inclined obliquely forward. The spokes provided may also be of a different shape and arrangement. The annular ring 20, spokes 24 and ring 26 may be made in one piece or connected together. A clamping screw 29 may be used for securing to the external housing 7.

A high voltage cable 14 runs through an outer connecting part 28, plastic ring 26 and one of the tubular spokes 24. The cable 14 is connected through an electrical contact means 16 at the top in FIG. 1) provided at the end of spoke 24 to conductor 12, connecting charging electrodes 10 together. The high voltage potential applied to the electrodes 10 may be, for example, between 60 and 80 kV or more. The electrical contact means 16 may contain a compression spring 17 and a contact pin 18 screwed to a conductor 12, for example. One advantage of the apparatus described herein is that electrical contact with the external electrodes 10 requires only a single high voltage cable, whereas the prior art apparatus has electrodes each mounted in their own holders and a separate cable runs from the interior to each electrode. That cable must be connected externally of the holder to the other cables at a junction point.

The number of charging electrodes 10 is, of course, not limited to the particular number chosen in the preferred embodiment. The number of electrodes 10 should, however, be such as to provide a sufficiently short distance between the electrodes 10 in order to avoid any danger of the front end face of the annular ring 20 being contaminated by the coating material. If the circle of electrodes has a diameter of 100 mm, the number of electrodes 10 used should be between 18 and 30. A substantially smaller number of electrodes would result in an abrupt increase in contamination, i.e., in coating the end face 21 which would connect conductively the electrodes outside the insulated annular ring 20, with the consequences indicated at the beginning hereof; whereas more than 30 electrodes would, in this example, merely increase the cost of the unit without substantially improving the electrical field. If a smaller or larger diameter is selected for the circle of electrodes, the possible minimal number thereof must be reduced or increased accordingly. Over a relatively large range of diameters on each side of the 400 mm used in the example described, the distance between the electrode tips should be between about 40 and 70 mm.

The radial distance between the electrode tips and spraying edge 6 should be more than twice the diameter in this case about 70 mm of the spraying edge 6 in the prior art apparatus. A presently preferred range of possible electrode circle diameters amounts to about 350 to 450 mm.

Also of importance for the danger of contamination is the axial location of the electrode tips in relation to the plane of spraying edge 6. As in the prior art apparatus, in the design illustrated in FIG. 1 the electrode tips should be set back axially at a certain distance behind the spraying edge 6. The distance must be such as to provide a reasonable compromise between the charging of the sprayed coating material which improves as the distance decreases and the simultaneously increasing contamination, especially of bell plate 2 and of the atomizer housing. In the example illustrated, axially measured distances of between 25 and 60 mm, preferably about 50 mm, have been found satisfactory. Generally, the front ends of the electrode tips should be set back axially behind the plane of the spraying edge by less than $\frac{1}{3}$, preferably by $\frac{1}{4}$ at the most, of the radial distance between the electrode tips and spraying edge 6.

As aforementioned, an electrically conductive connection between the charging electrodes outside annular ring 20 constituting the electrode holder, produced by coating with conductive material (water enamel) is to be avoided according to the subject invention. As illustrated, in FIG. 1, this may be accomplished largely by a corresponding minimal number of electrodes and by limiting the distance between them to a maximal value. It may, however, be desirable to provide additional measures for prevented unwanted coating.

Figure 3:
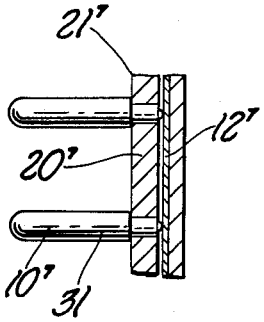
FIG. 3 is a side view which shows an alternative embodiment of the annular element of the subject invention.

A first additional measure is to increase the "leakage current" or surface path between the electrode tips. In so doing, it is possible, as shown in FIG. 3, to embed, or at least enclose, long needle-like electrodes 10' in pins 31 made of insulating material and projecting in the manner of fingers, from end face 21' of annular element 20' axially towards the object to be coated. The rear ends of the pins 31 may be inserted into annular element 20' or may be molded thereto. Electrodes 10' are located with their first ends exposed in depressions in the front end of each pin similar to depression 22, whereas the rear ends are connected to a conductor 12', as in the preferred embodiment illustrated in FIG. 3.

Figure 4:
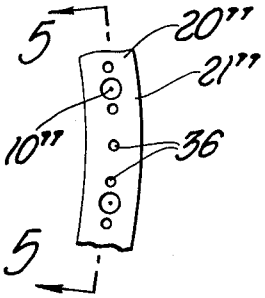
FIG. 4 is a fragmentary from view which shows an alternative embodiment of the annular element of the subject invention.
Figure 5:
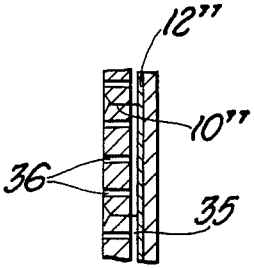
FIG. 5 is a side view taken substantially along line 5—5 of FIG. 4.

Another additional measure shown in FIGS. 4 and 5 is to provide in the interior of annular element 12", an antiparticulate means for preventing coating material from being deposited on the end face 21. The antiparticulate means includes an annular fluid duct 35 which is subjected to fluid pressure and from axially opening fluid apertures 36 lead outwardly to end face 21" of the annular element 12" between charging electrodes 10". The fluid, preferably air emerging from apertures 36, keeps the coating material away from the end face. Fluid duct 35 may be connected to an external source of compressed air or some other fluid, generally indicated by arrow 37 in FIG. 1 through one of the spokes 24, preferably the one which does not contain high voltage cable 14.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus for electrostatic coating of objects with an electrically conductive coating material comprising: a rotary atomizer (1) including a spraying head (2); an external housing (7) connected to said spraying head (2); a line supplying coating material from a storage system to a spraying edge (6) on said spraying head, said line and the coating material being at ground potential to said spraying head; charging electrodes (10) distributed radially around said spraying head (2) on a circle concentric with the axis thereof and spaced at uniform angular distances, said electrodes (10) being connected to a high voltage source for the purpose of producing an electrical field for charging the coating material, the radial distance between the front ends of said electrodes (10) facing the object to be coated and said spraying head (2) being twice the diameter of said spraying head (2); an electrode mounting means (20) made of an insulating material in which said charging electrodes (10), except for their front ends, are enclosed, said mounting means (20) having at least one support (24) running radially from said external housing (7) of said spraying head (2) and containing a high voltage conductor (12) connected electrically to said charging electrodes (10), and characterized by said mounting means being an annular ring (20) surrounding said external housing (7) of said spraying head (2) at a distance therefrom and made of an insulating material, said charging electrodes (10) being inserted into said annular ring (20), an electrical conductor (12) disposed within said annular ring (20) connecting said charging electrodes (10) annularly to each other and is connected to the high voltage cable conductor (14), said mounting means having an end face (21) including depressions (22) disposed on the front of said end face (21) at the point where said electrodes (10) are exposed, said conductor (12) being electrically insulated from the end face (21), facing the object to be coated of the annular ring (20), whereby the distance between said charging electrodes (10) are such that, while the unit is in operation, there is no substantial deposit of coating material upon the end face (21) of said annular ring (20).

2. An apparatus as set forth in claim 1 further characterized by the diameter of the circle upon which the ends of said electrodes lie exceeds 200 mm, at least nine charging electrodes (10) are provided.

3. An apparatus as set forth in claim 2 further characterized by the diameter of the circle being about 400 mm or more, at least eighteen charging electrodes are provided.

4. An apparatus as set forth in claim 1 further characterized by said annular insulating ring (20) being made of polypropylene (PPP).

5. An apparatus as set forth in claim 4 further characterized by the front ends of said electrodes (10) being located and exposed in a depression (22) having an aperture angle of more than 90°.

6. An apparatus as set forth in claim 5 further characterized by said annular element (12") comprising antiparticulate means (35) for preventing coating material from being deposited onto its end face (21").

7. An apparatus as set forth in claim 6 further characterized by said antiparticulate means including a fluid duct (35) disposed on the interior of said ring (20") adjacent said conductor (12") which is subjected to fluid pressure and including apertures (36) opening axially in the end face (21") between the electrodes (10") in fluid communication with said duct (35).

8. An apparatus as set forth in claim 7 further characterized by the front ends of said charging electrodes (10) being set back axially less than ⅓ the radial distance between said electrodes (10) and said spraying edge (6) behind the plane thereof.

9. An apparatus for electrostatic coating of objects with an electrically conductive coating material including an external housing (7), a rotary atomizer (1) mounted on said housing (7), an electrode mounting means (20) disposed annularly and radially about said atomizer (1) a plurality of electrode means (10) spaced annularly about said mounting means (20) for creating an electrical field between said electrode means (10) and the object to be coated, an electrical conductor (12) disposed within said electrode mounting means (20) and establishing an electrical connection between all of said electrode means (10) and a high voltage source, said electrode mounting means (20) having an end face (21) said electrical conductor (12) being electrically insulated from said end face (21) to prevent particulate contamination of said end face (21) by the coating material, said electrode means (10) including electrodes mounted substantially within said electrode mounting means (20) and having only a small portion extending beyond said end face (21) of electrode mounting means (20), said end face (21) including depressions (22) disposed on the front of said and face (21) at the point where said electrode (10) is exposed.

10. An apparatus as set forth in claim 1 further characterized by said electrode mounting means (20) being a continuous insulated annular ring and including at least one electrode mounting support (24) extending from said housing (7) to said electrode mounting means (20).

11. An apparatus as set forth in claim 9, further characterized by said electrode means (10') including pin means (31) enclosing said electrodes (10') extending form said end face (21') of said ring (20') for obtaining a substantial increase in the surface path between the exposed front ends of said electrode means (10').

12. An apparatus as set forth in claim 11 further characterized by said ring (20) including electrical contact means (16) for providing electrical power between said conductor (12) and said high voltage source.

13. An apparatus as set forth in claim 12, further characterized by said electrical contact means (16) including a compression spring (17) disposed on the end of an electrical cable (14) and a contact pin (18) secured to the conductor (12) for maintaining an electrical current between said conductor (12) and the high voltage source.

14. An apparatus as set forth in claim 13 further characterized by said ring (20") including an antiparticulate means (35, 36) for preventing coating material from being deposited onto said end face (21").

15. An apparatus as set forth in claim 14 further characterized by said antiparticulate means including a fluid duct (35) disposed on the interior of said ring (20") adjacent said conductor (12") and apertures (36) disposed on said end phase (21") and in fluid communication with said duct (35) for allowing a flow of fluid through said duct (35) and said aperture (36) for preventing coating materials from being deposited on said end face (21").

16. An apparatus as set forth in claim 15 further characterized by including a coating supply line and said rotary atomizer (1) and said supply line being electrically grounded.

17. An apparatus as set forth in claim 16 further characterized by the diameter of the circle upon which the ends of said electrode lie exceeds 200 mm, at least nine charging electrodes (10) are provided.

18. An apparatus as set forth in claim 17 further characterized by the diameter of the circle being about 400 mm or more, at least eighteen charging electrodes are provided.

19. An apparatus as set forth in claim 18 further characterized by said annular insulating element (20) being made of polypropylene (PPP).

20. An apparatus as set forth in claim 19 further characterized by the front ends of said charging electrodes (10) being set back axially less than ⅓ the radial distance between said electrodes (10) and said spraying edge (6) behind the plane thereof.

21. An apparatus for electrostatically coating of objects with an electrically conductive coating material comprising, an external housing (7), an atomizer (1) including a spraying head (2) having an annular atomizing spray edge (6) defining a forward end of the apparatus, feed means for supplying coating material from a supply source to said spraying head, said spraying edge also defining a predetermined diameter for atomizing the material and projecting the atomized material radially therefrom, said atomizer (1) mounted on said housing (7), an electrode mounting means (20) disposed annularly and radially about said atomizer (1), a plurality of electrode means (10) spaced annularly about said mounting means (20) for creating an electrical field between said electrode means (10) and the object to be coated, said assembly (10) characterized by an electrical conductor (12) disposed within said electrode mounting means (20) and establishing an electrical connection between all of said electrode means (10) and a high voltage source, said electrode means (10) being positioned on said electrode mounting means (20) radially outward from said spraying edge (6) of said spraying head (2) a predetermined radial distance which is at least twice the predetermined diameter of said spray edge (6) of said spraying head (2) and said electrode means (10) located axially rearward from said forward end of said spray edge (6) of the spraying head (2) at a distance which is not greater than one third the radial distance between the electrode means (10) and the spray edge (6).

22. An apparatus as set for in claim 21 further characterized by said electrode mounting means (20) being a continuous annular ring and including at least one electrode mounting support (24 ) extending from said housing (7) to said electrode mounting means (20).

* * * * *